United States Patent [19]

Marshall

[11] Patent Number: 5,006,751

[45] Date of Patent: Apr. 9, 1991

[54] ELECTRIC LAMP AND ADAPTER SOCKET THEREFOR

[76] Inventor: Rodney G. Marshall, 1219 Meadowridge Trail, Goshen, Ky. 40026

[21] Appl. No.: 392,408

[22] Filed: Aug. 11, 1989

[51] Int. Cl.[5] ..... H01J 5/54; H01J 5/60

[52] U.S. Cl. ..... 313/51; 313/318; 439/236; 439/613; 439/615; 439/628

[58] Field of Search ..... 313/51, 318; 439/613, 439/611, 628, 615, 236

[56] References Cited

U.S. PATENT DOCUMENTS

| | | | |
|---|---|---|---|
| 884,271 | 4/1908 | Frankofski | 313/51 X |
| 3,112,894 | 12/1963 | Pearlman . | |
| 3,126,160 | 3/1964 | Berger . | |
| 3,883,734 | 5/1975 | Joiner et al. . | |
| 4,121,134 | 10/1978 | Fontenelle | 313/51 X |
| 4,514,794 | 4/1985 | Haberthür-Heilig . | |
| 4,683,402 | 7/1987 | Aubrey | 439/236 X |
| 4,704,668 | 11/1987 | Kosek . | |

*Primary Examiner*—Palmer C. DeMeo
*Attorney, Agent, or Firm*—Leon Gilden

[57] ABSTRACT

An improved bulb and adapter socket is provided with a ribbed base wherein the ribs are equally spaced about an external surface of the base and receivable within elongate slits within an adapter socket. A spring ring is receivable within an annulus within the base to effect electrical contact with the base, wherein the adapter and bulb are receivable within a conventional threaded electrical socket.

5 Claims, 4 Drawing Sheets

FIG 4
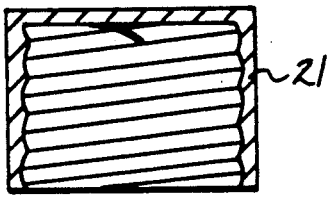
PRIOR ART
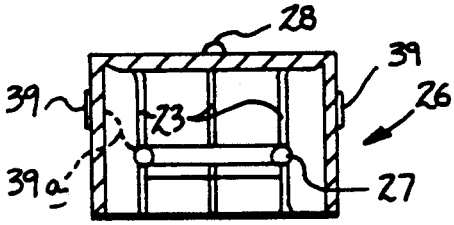
FIG 5

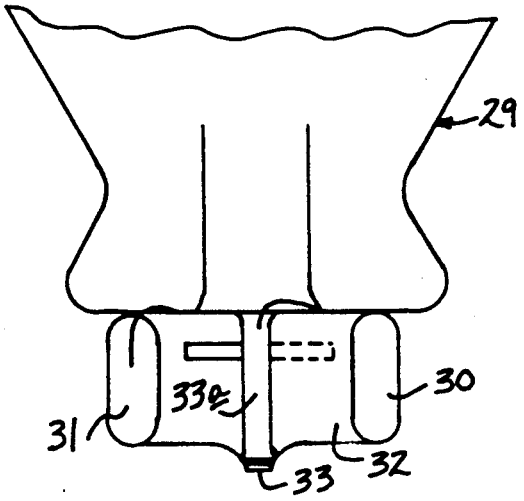
FIG 6
FIG 7
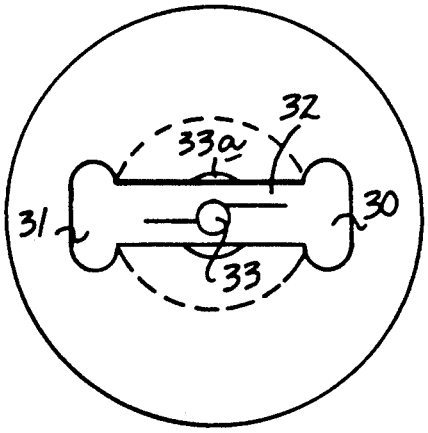
FIG 8
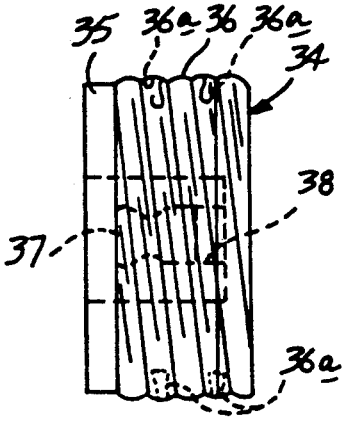

ELECTRIC LAMP AND ADAPTER SOCKET THEREFOR

BACKGROUND OF THE INVENTION

1. Field of the Invention

The field of invention relates to light bulb arrangements, and more particularly pertains to a new and improved light bulb and adapter socket arrangement wherein the adapter socket is receivable within a conventional electrical socket to provide ease of insertion and removal of the light bulb within the conventional light bulb socket.

2. Description of the Prior Art

Various arrangements have heretofore been provided to electrically associate a light bulb with an associated receptacle base. The prior art, however, has heretofore failed to minimize the oxidation and attendant difficulties in the replacement of light bulbs within an electrical socket. Examples of the prior art include U.S. Pat. No. 3,883,734 to Joiner illustrating a typical configuration of the prior art to minimize resistance when inserting and removing a bulb within a conventional socket, wherein pin projections interfit within recesses formed within the socket to secure the bulb base within the electrical socket.

U.S. Pat. No. 4,514,794 to Heilig illustrates the use of an adapter plate provided with an opening for a bayonet-type reception of a flanged base of an electrical illumination device.

U.S. Pat. No. 3,126,160 to Berger illustrates various socket shells for receiving electrical bulbs utilizing relative rotation between the shells and the bulb.

U.S. Pat. No. 3,112,894 to Pearlman provides for a reflector adapter frictionally receivable overlying the electrical socket about a base of a conventional light bulb.

U.S. Pat. No. 4,704,668 to Kosek provides a sleeve-type socket with pad means securable about the lowermost portion of the bulb to stabilize the bulb in its securement to the socket.

As such, it may be appreciated that there is a continuing need for a new and improved bulb and socket adapter arrangement wherein the same addresses both the problems of ease of use and effectiveness in construction, the present invention substantially fulfills this need.

SUMMARY OF THE INVENTION

In view of the foregoing disadvantages inherent in the known types of light bulbs and adapters now present in the prior art, the present invention provides an improved light bulb and adapter socket wherein the same utilizes a bulb base in a complementary socket receivable within a conventional socket to provide electrical communication between the light bulb and the socket. As such, the general purpose of the present invention, which will be described subsequently in greater detail, is to provide a new and improved light bulb and adapter socket which has all the advantages of the prior art light bulb and socket arrangements and none of the disadvantages.

To attain this, the present invention includes a light bulb formed with a base defined by a series of circumferentially and axially parallel ribs receivable within grooves of an adapter, wherein the adapter further includes a resilient split ring receivable within an annulus to provide electrical communication between the split ring and the base. A further embodiment provides for a press fit adapter socket provided with a communicating annular bay and receivable within a conventional electrical socket and provided with the aforenoted grooves and split ring for securement of the bulb therewith. A further adapter socket arrangement provides for a central socket receiving a web defined between diametrically opposed "C" shaped legs about a base of a light bulb.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved light bulb and adapter socket which has all the advantages of the prior art adapter sockets and none of the disadvantages.

It is another object of the present invention to provide a new and improved light bulb and adapter socket which may be easily and efficiently manufactured and marketed.

It is a further object of the present invention to provide a new and improved light bulb and adapter socket which is of a durable and reliable construction.

An even further object of the present invention is to provide a new and improved light bulb and adapter socket which is susceptible of a low cost of manufacture with regard to both materials and labor, and which accordingly is then susceptible of low prices of sale to the consuming public, thereby making such light bulbs and adapter sockets economically available to the buying public.

Still yet another object of the present invention is to provide a new and improved light bulb and adapter socket which provides in the apparatuses and methods of the prior art some of the advantages thereof, while simultaneously overcoming some of the disadvantages normally associated therewith.

Still another object of the present invention is to provide a new and improved light bulb and adapter socket wherein the same enables an axially oriented sliding arrangement between the socket and an associated light bulb wherein the adapter socket is receivable within a conventional electrical socket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a cross-sectional view of a conventional socket utilized by the prior art.

FIG. 5 is a cross-sectional view of a modified adapter socket utilized by the instant invention.

FIG. 6 is a side view taken in elevation of a modified light bulb and base.

FIG. 7 is a bottom plan view of the light bulb and base as illustrated in FIG. 6.

FIG. 8 is a side view of a modified adapter socket to receive the base portion of the light bulb as illustrated in FIGS. 6 and 7.

DESCRIPTION OF THE PREFERRED EMBODIMENT

Figure 1:
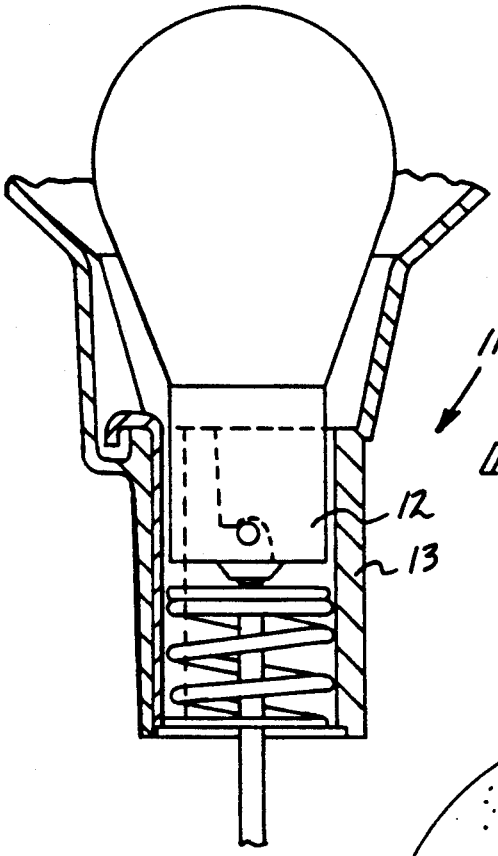
Fig 1 PRIOR ART
FIG. 1 is a side view of a prior art light bulb and socket arrangement.
Figure 2:
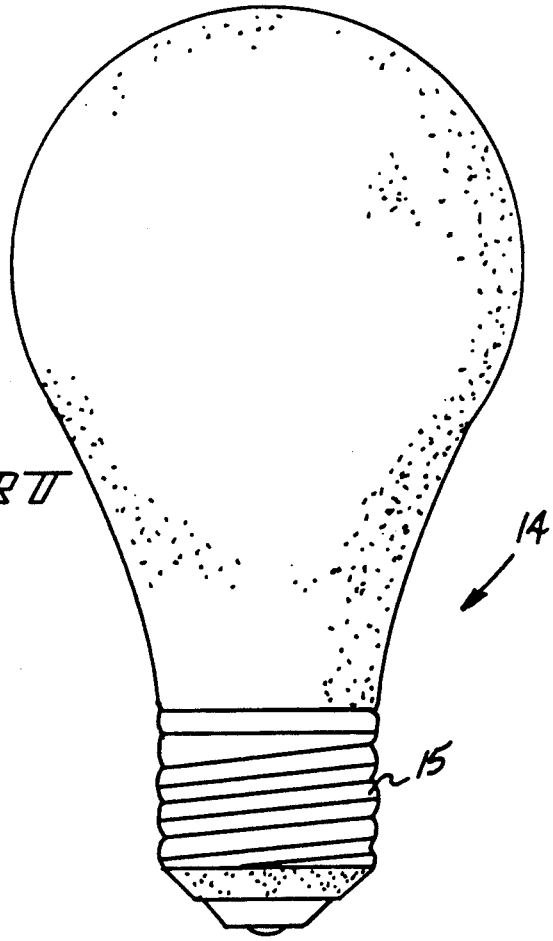
Fig 2 PRIOR ART
FIG. 2 is a side view of a conventional light bulb.

With reference now to the drawings, and in particular to FIGS. 1 to 8 thereof, a new and improved light bulb and adapter socket embodying the principles and concepts of the present invention and generally designated by the reference numeral 10 will be described.

More specifically, the light bulb and adapter socket 10 of the instant invention is arranged to provide an improvement over a conventional light bulb 14 formed with a threaded base 15, as utilized in the prior art. FIG. 1 illustrates a prior art bulb and socket assembly 11 wherein the bulb base 12 is provided with orthogonally oriented pins receivable within recesses formed within the socket 13 to minimize rotational inter-relationship of the light bulb and the socket 13.

Figure 3:
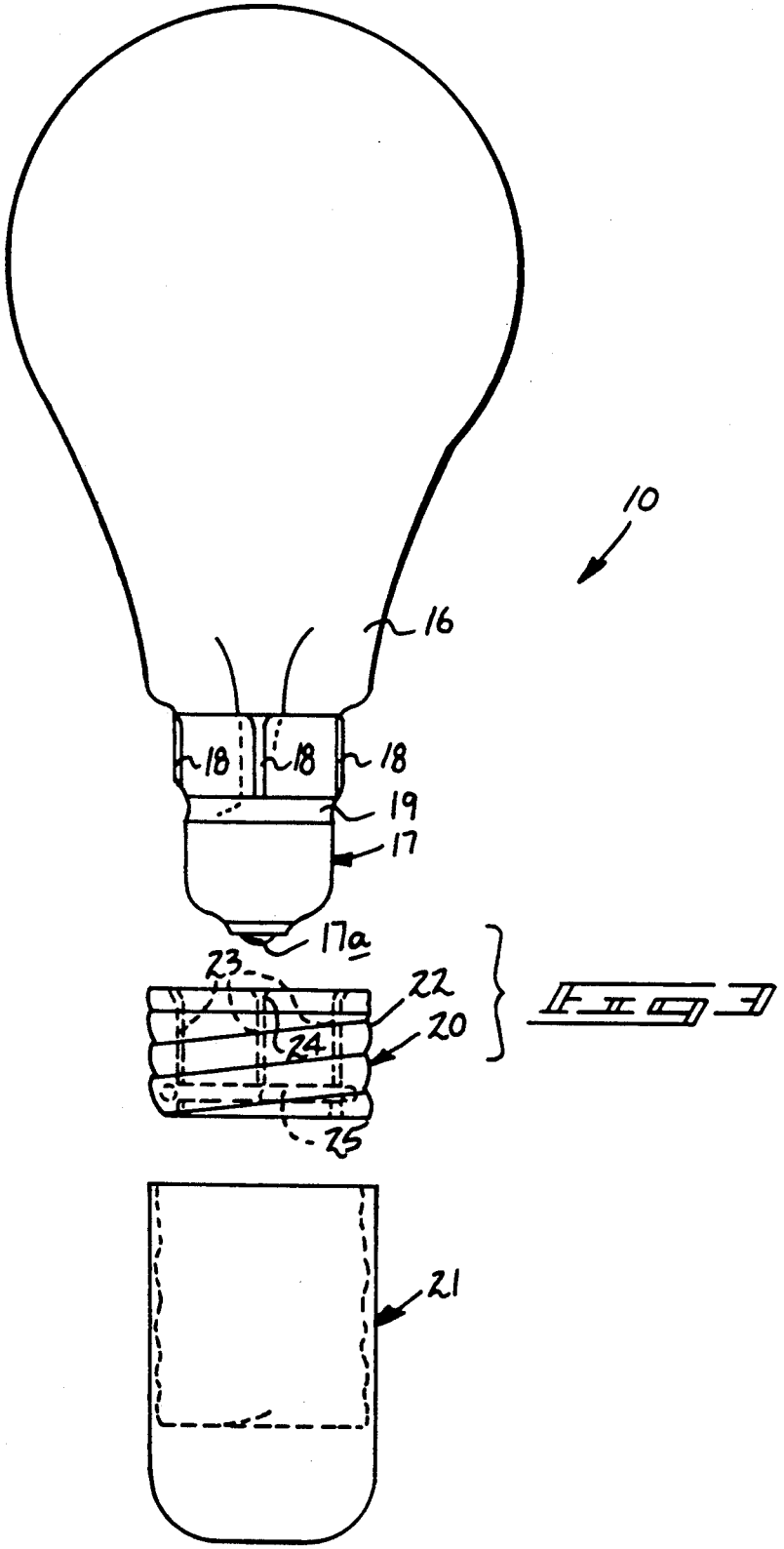
FIG. 3 is a side view taken in elevation of the light bulb and adapter socket assembly relative to a conventional electrical socket in a disassembled orientation relative to one another.

Attention to FIG. 3 illustrates the improved light bulb and socket arrangement 10 wherein a conventional luminescent bulb member 16 is formed with an improved bulb base 17. The bulb base 17 is provided with axially parallel elongate ridges 18 equally spaced about the cylindrical base 17 between the luminescent bulb 16 and an annular recess 19 formed medially within the base 17. The base 17 is slidably receivable within a socket adapter 20. The socket adapter 20 is in turn threadedly mounted within a conventional threaded electrical socket 21. The adapter 20 includes an externally threaded exterior surface 22 to be received within the threaded socket 21 and is formed with elongate grooves 23 each formed with a flared entrance 24 to receive a respective ridge 18 therewithin. It is contemplated that a plurality of three to four such ridges 18 and associated grooves 23 are to be formed relative to one another within the bulb and adapter socket arrangement. A split lock ringer 25 is formed within the socket adapter 20 to lock the adaptor in registration with the base 17 by its reception within the annular recess 19 of the base 17. The base 17 is readily removable relative to the adapter 20 by manually imposing pressure upon the lowermost tip 17*a* of the base 17 while securing the adapter 22 and relatively pushing the base 17 outwardly of the adapter 20.

FIG. 5 illustrates the use of a press-in socket 26 frictionally receivable within a conventional threaded socket 21 wherein the socket 26 is formed with a spring-biased lock ring 27 and associated ground connector 28 to complete electrical communication of the socket 26 relative to the conventional threaded socket 21. The annular band 39 cooperates with the threaded portion of the socket 21 which is in electrical communication with the spring biased lock ring 27 by a conventional electrical wire or the like 39*a*. The grooves 23 receive the base 17 in a manner as set forth above.

FIG. 6 is illustrative of a modified bulb 29 formed with a respective first and second outwardly biased plurality of legs 30 and 31 of a generally "C" shaped cross-sectional configuration intercommunicated by a split spring steel connecting web 32 to bias the legs 30 and 31 outwardly for reception within a further socket adapter 34. An axial ground node 33 extends below the legs 30 and 31 and is formed with an enlarged coaxial cylindrical shaft 33*a* receivable within a central socket 37 of complementary configuration to the web 32 and formed with a coaxial aligned bore 38 to receive the shaft 33*a*. The socket adapter 34 is formed within an insulative ceramic 35 with a conductive threaded band 36 formed thereabout, wherein the band 36 is in electrical communication with the legs 30 and 31 through the use of inwardly directed conductive projections 36*a*. The projections 36*a* are diametrically opposed to one another and are in alignment with diametrically opposed legs 30 and 31 of the modified bulb 29.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An electric lamp and adapter socket receivable within an internally threaded electrical socket comprising an electric light bulb formed with a conductive base, said base including a plurality of elongate registration members directed exteriorly of the base and symmetrically arranged about a central electrical contact axially aligned and extending below the registration members, and an adapter socket receivable within the threaded electrical socket including recessed members for receiving the registration members, and wherein the registration members include a plurality of elongate ridges symmetrically formed about the base, and wherein the base further includes an annular recess formed medially of the base and wherein the ridges extend from the electric light bulb to the annular recess, and wherein the annular recess extends above a lowermost terminal end of the central electrical contact.

2. An electric lamp and adapter socket as set forth in claim 1 wherein the adapter socket further includes a split lock ring medially positioned interiorly of the adapter socket and receivable within the annular recess to effect electrical communication of the recess to the socket.

3. An electric lamp and adapter socket as set forth in claim 2 wherein the adapter socket is formed with an externally threaded surface threadedly receivable within the electrical socket.

4. An electric lamp and adapter socket as set forth in claim 2 wherein the adapter socket is formed with a relatively smooth exterior surface including an electrical band in communication with the split lock ring and the adapter socket slidably receivable within the internally threaded electrical socket.

5. An electric lamp and adapter socket as set forth in claim 1 wherein the registration members include a first and second diametrically opposed leg, each leg formed of a generally "C" shaped configuration with a central web biasing the legs outwardly of the base for electrical communication with the adapter socket.

* * * * *